US009947284B2

(12) United States Patent
Park et al.

(10) Patent No.: US 9,947,284 B2
(45) Date of Patent: Apr. 17, 2018

(54) DISPLAY APPARATUS SELECTING AND APPLYING EXTERNAL VOLTAGE AND METHOD OF DRIVING THE SAME

(71) Applicant: Samsung Display Co., LTD., Yongin-si, Gyeonggi-Do (KR)

(72) Inventors: Cheol-Woo Park, Suwon-si (KR); Seung-Hwan Park, Anyang-si (KR); Geun-Jeong Park, Daegu (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/092,083

(22) Filed: Apr. 6, 2016

(65) Prior Publication Data

US 2017/0110084 A1 Apr. 20, 2017

(30) Foreign Application Priority Data

Oct. 15, 2015 (KR) ..... 10-2015-0144197

(51) Int. Cl.
*G09G 5/00* (2006.01)
*G09G 3/36* (2006.01)

(52) U.S. Cl.
CPC ..... *G09G 3/3688* (2013.01); *G09G 3/3696* (2013.01); *G09G 2310/027* (2013.01); *G09G 2310/0251* (2013.01); *G09G 2310/0297* (2013.01); *G09G 2330/023* (2013.01)

(58) Field of Classification Search
CPC ..... G09G 2310/027; G09G 2310/0297; G09G 3/3685; G09G 3/3688; G09G 3/3291; G09G 3/3275; G09G 2310/0251
USPC ..... 345/212
See application file for complete search history.

(56) References Cited

U.S. PATENT DOCUMENTS

2008/0284771 A1* 11/2008 Matsuki ..... G09G 3/3692 345/211
2008/0303809 A1* 12/2008 Lee ..... G09G 3/3648 345/215
2009/0128533 A1* 5/2009 Tsubata ..... G02F 1/13624 345/209
2009/0303166 A1* 12/2009 Tsubata ..... G09G 3/342 345/87
2013/0050172 A1* 2/2013 Li ..... G09G 3/20 345/212
2014/0035899 A1* 2/2014 Lai ..... G02F 1/1309 345/212

(Continued)

*Primary Examiner* — Yuzhen Shen
(74) *Attorney, Agent, or Firm* — Cantor Colburn LLP

(57) ABSTRACT

A display apparatus includes a display panel including a first data line, a timing controller which generates an external voltage selection signal, a channel control signal and a data signal, an external voltage generator which selects one of first voltage levels based on the external voltage selection signal to generate a first external voltage, and a data driver including a channel voltage generator which generates a first channel voltage, a first channel line connected to the first data line, a first switch connected between a first node receiving the first channel voltage and a second node connected to the first channel line, and a second switch connected between a third node receiving the first external voltage and a fourth node connected to the first channel line, where the data driver controls operations of the first and second switches based on the channel control signal.

16 Claims, 12 Drawing Sheets

(56) References Cited

U.S. PATENT DOCUMENTS

| | | | |
|---|---|---|---|
| 2016/0049133 | A1 | 2/2016 | Park et al. |
| 2016/0078841 | A1 | 3/2016 | Park et al. |

* cited by examiner

DISPLAY APPARATUS SELECTING AND APPLYING EXTERNAL VOLTAGE AND METHOD OF DRIVING THE SAME

This application claims priority to Korean Patent Application No. 10-2015-0144197, filed on Oct. 15, 2015, and all the benefits accruing therefrom under 35 U.S.C. § 119, the content of which in its entirety is herein incorporated by reference.

BACKGROUND

1. Field

Exemplary embodiments of the invention relate generally to display devices, and more particularly to display apparatuses and methods of driving the display apparatuses.

2. Description of the Related Art

Generally, a liquid crystal display ("LCD") apparatus includes a first substrate including a pixel electrode, a second substrate including a common electrode and a liquid crystal layer disposed between the first and second substrates. An electric field is generated by voltages applied to the pixel electrode and the common electrode, respectively. By adjusting an intensity of the electric field, a transmittance of a light passing through the liquid crystal layer may be adjusted so that a desired image may be displayed.

The LCD apparatus includes a display panel and a panel driver. The display panel includes a plurality of gate lines, a plurality of data lines and a plurality of pixels connected to the gate lines and the data lines. The panel driver generally includes a gate driver providing gate signals to the gate lines and a data driver providing data voltages to the data lines.

SUMMARY

Recently, a size of the display panel and a frame rate are increasing for improving display quality. Thus, power consumption and heating of the data driver increase as the size of the display panel and the frame rate increase.

Exemplary embodiments of the invention provide a display apparatus capable of improving display quality.

Exemplary embodiments of the invention provide a method of driving the display apparatus.

A display apparatus according to an exemplary embodiment of the invention includes a display panel including a first data line and a first pixel connected to the first data line, a timing controller which generates an external voltage selection signal, a channel control signal and a data signal based on input image data, an external voltage generator which selects one of first voltage levels based on the external voltage selection signal to generate a first external voltage having a first selection level, and a data driver including a channel voltage generator which generates a first channel voltage corresponding to the first pixel based on the data signal, a first channel line connected to the first data line, a first switch connected between a first node receiving the first channel voltage and a second node connected to the first channel line, and a second switch connected between a third node receiving the first external voltage and a fourth node connected to the first channel line, where the data driver controls operations of the first and second switches based on the channel control signal.

In an exemplary embodiment, the display panel may include a first pixel group including the first pixel and disposed on a first horizontal line. The timing controller may generate the external voltage selection signal based on first input image data corresponding to the first pixel group.

In an exemplary embodiment, each of data voltages corresponding to the first input image data may be classified to one of voltage ranges. The first selection level corresponding to a first voltage range may be selected based on the external voltage selection signal, the first voltage range among the voltage ranges including a greatest number of data voltages.

In an exemplary embodiment, the external voltage generator may further select one of second voltage levels based on the external voltage selection signal to generate a second external voltage having a second selection level.

In an exemplary embodiment, a polarity of the first external voltage may be substantially opposite to a polarity of the second external voltage.

In an exemplary embodiment, the data driver may further include a third switch connected between a fifth node receiving the second external voltage and a sixth node connected to the first channel line. The data driver may further control operation of the third switch based on the channel control signal.

In an exemplary embodiment, the external voltage generator may include a multiplexer which selects the first selection level based on the external voltage selection signal to output the first external voltage.

In an exemplary embodiment, the display panel may further include a second pixel connected to the first data line and adjacent to the first pixel. The timing controller may compare first input image data corresponding to the first pixel and second input image data corresponding to the second pixel to generate the channel control signal.

In an exemplary embodiment, the display panel may further include a second data line and third and fourth pixels connected to the second data line and adjacent to each other. The timing controller further may compare third input image data corresponding to the third pixel and fourth input image data corresponding to the fourth pixel to generate the channel control signal. The channel voltage generator may further generate a second channel voltage corresponding to the third pixel based on the data signal. The data driver further include a second channel line connected to the second data line, a third switch connected between a fifth node receiving the second channel voltage and a sixth node connected to the second channel line, and a fourth switch connected between a seventh node receiving the first external voltage and an eighth node connected to the second channel line. The data driver may further control operations of the third and fourth switches based on the channel control signal.

In an exemplary embodiment, the display panel may further include a second data line adjacent to the first data line. The data driver may further include a second channel line connected to the second data line, and a third switch connected between a fifth node connected to the first channel line and a sixth node connected to the second channel line. The data driver may further control operations of the third switch based on the channel control signal.

In an exemplary embodiment, when the first switch is turned on, the second switch may be turned off. When the first switch is turned off, the second switch may be turned on.

In an exemplary embodiment, the first pixel may be turned on during a first horizontal duration including early and latter parts. The first switch is turned off during the early part and the second switch is turned off during the latter part.

In an exemplary embodiment, the latter part is subsequent to the early part.

A method of driving a display apparatus according to an exemplary embodiment of the invention includes generating an external voltage selection signal, a channel control signal and a data signal based on input image data, selecting one of first voltage levels based on the external voltage selection signal to generate a first external voltage having a first selection level, generating a first channel voltage corresponding to the first pixel based on the data signal, and applying one of the first external voltage and the first channel voltage to the first pixel based on the channel control signal.

In an exemplary embodiment, the generating the external voltage selection signal may include generating the external voltage selection signal based on first input image data corresponding to a first pixel group, the first pixel group including the first pixel and disposed on a first horizontal line of a display panel.

In an exemplary embodiment, the generating the external voltage selection signal may include classifying each of data voltages corresponding to the first input image data to one of voltage ranges. The selecting the one of the first voltage levels may include selecting the first selection level corresponding to a first voltage range based on the external voltage selection signal, the first voltage range among the voltage ranges including a greatest number of data voltages.

In an exemplary embodiment, the selecting the one of the first voltage levels may include selecting one of second voltage levels based on the external voltage selection signal to generate a second external voltage having a second selection level.

In an exemplary embodiment, the generating the channel control signal may include comparing first input image data corresponding to the first pixel and second input image data corresponding to a second pixel to generate the channel control signal, the second pixel being adjacent to the first pixel.

In an exemplary embodiment, the applying the one of the first external voltage and the first channel voltage may include applying the first external voltage to the first pixel during a first horizontal duration, and applying the first channel voltage to the first pixel during a second horizontal duration.

In an exemplary embodiment, the second horizontal duration may be subsequent to the first horizontal duration.

According to exemplary embodiments, a proper external voltage may be selected based on input image data corresponding to each horizontal period, and the selected external voltage may be applied instead of a data voltage during an early part of the horizontal period to reduce power consumption and heating of a data driver. Thus, a display quality of the display panel may be improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
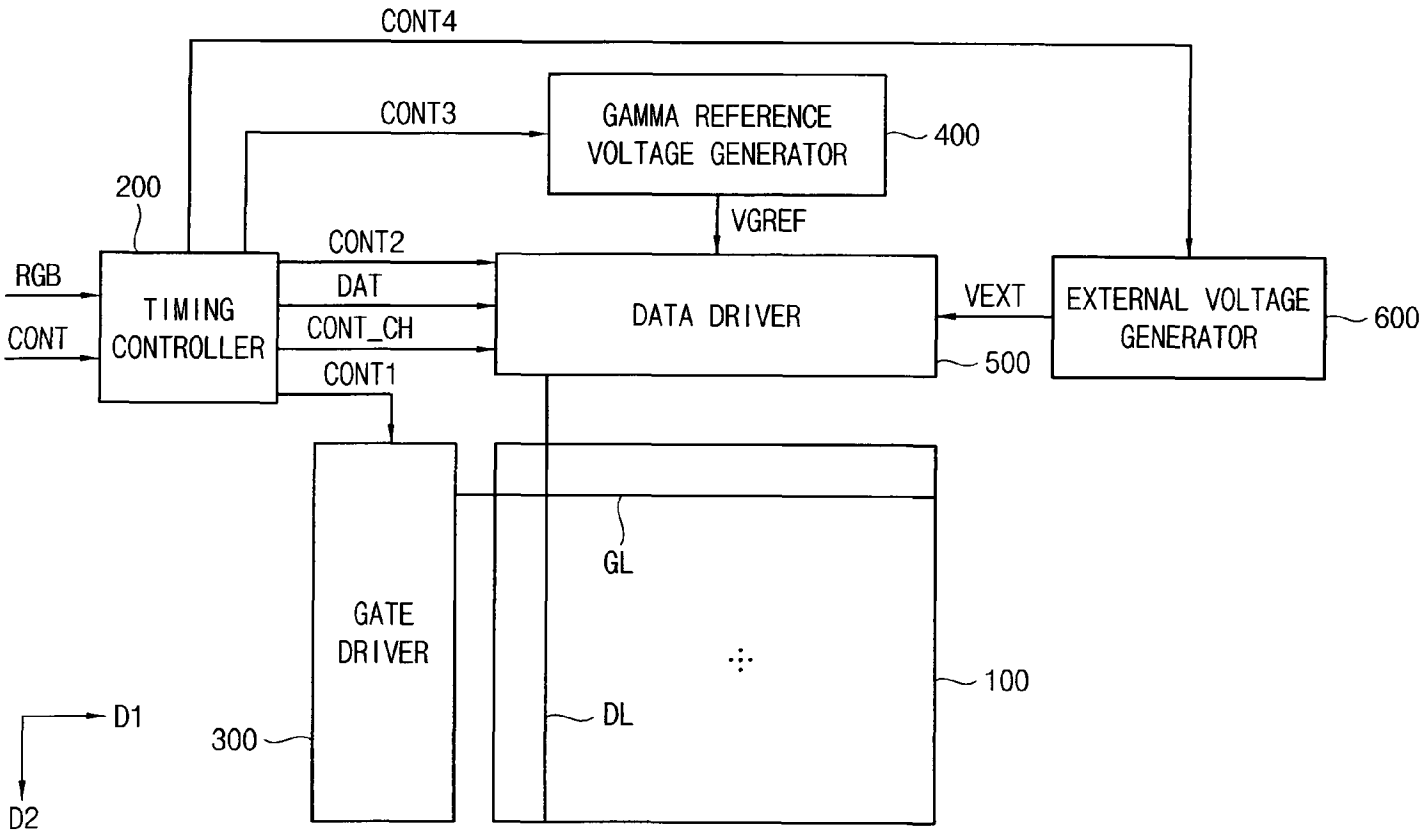
FIG. 1 is a block diagram illustrating exemplary embodiments of a display apparatus according to the invention.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to exemplary embodiments.

Referring to FIG. 1, the display apparatus includes a display panel 100 and a panel driver. The panel driver includes a timing controller 200, a gate driver 300, a gamma reference voltage generator 400, a data driver 500 and an external voltage generator 600.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In exemplary embodiments, the pixels may include a switching element (not shown), a liquid crystal capacitor (not shown) and a storage capacitor (not shown). The liquid crystal capacitor and the storage capacitor may be electrically connected to the switching element. In an exemplary embodiment, the pixels may be arranged in a matrix configuration. However, the invention is not limited thereto, and pixels may be arranged in various other shapes.

The display panel 100 will be explained in detail with reference to FIG. 2.

The timing controller 200 receives input image data RGB and an input control signal CONT from an external device (not shown). In an exemplary embodiment, the input image data RGB may include red image data R, green image data G and blue image data B, for example. However, the invention is not limited thereto, and the input image data may include various other color data. In an exemplary embodiment, the input control signal CONT may include a master clock signal and a data enable signal. In the exemplary embodiment, the input control signal CONT may further include a vertical synchronizing signal and a horizontal synchronizing signal.

The timing controller 200 generates a first control signal CONT1, a second control signal CONT2, a third control signal CONT3, an external voltage selection signal CONT4, a channel control signal CONT_CH and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. In an exemplary embodiment, the first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. In an exemplary embodiment, the second control signal CONT2 may include a horizontal start signal and a load signal.

The timing controller 200 generates the data signal DAT based on the input image data RGB. The timing controller 200 outputs the data signal DAT to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 generates the external voltage selection signal CONT4 for controlling operations of the external voltage generator 600 based on the input image data RGB, and outputs the external voltage selection signal CONT4 to the external voltage generator 600.

The operations of the timing controller 200 will be explained in detail with reference to FIG. 3.

The gate driver 300 generates gate signals for driving the gate lines GL in response to the first control signal CONT1 received from the timing controller 200. The gate driver 300 sequentially outputs the gate signals to the gate lines GL.

In exemplary embodiments, the gate driver 300 may be directly disposed (e.g., mounted) on the display panel 100, or may be connected to the display panel 100 as a tape carrier package ("TCP") type. In an alternative exemplary embodiment, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In exemplary embodiments, the gamma reference voltage generator 400 may be disposed in the timing controller 200, or may be disposed in the data driver 500.

The external voltage generator 600 generates an external voltage VEXT in response to the external voltage selection signal CONT4 received from the timing controller 200. The external voltage generator 600 outputs the external voltage VEXT to the data driver 500.

Operations of the external voltage generator 600 will be explained in detail with reference to FIGS. 4A and 4B.

The data driver 500 receives the second control signal CONT2, the data signal DAT and the channel control signal CONT_CH from the timing controller 200, and receives the gamma reference voltage VGREF from the gamma reference voltage generator 400, and receives the external voltage VEXT from the external voltage generator 600. The data driver 500 converts the data signal DAT to channel voltages having analogue levels based on the gamma reference voltage VGREF. The data driver 500 generates data voltages based on the channel voltages and the external voltage VEXT. The data driver 500 outputs the data voltages to the data lines DL.

In exemplary embodiments, the data driver 500 may be directly disposed (e.g., mounted) on the display panel 100, or may be connected to the display panel 100 as a TCP type. In an alternative exemplary embodiment, the data driver 500 may be integrated on the peripheral region of the display panel 100.

Operations of the data driver 500 will be explained in detail with reference to FIGS. 5A, 5B, 5C and 5D.

Figure 2:
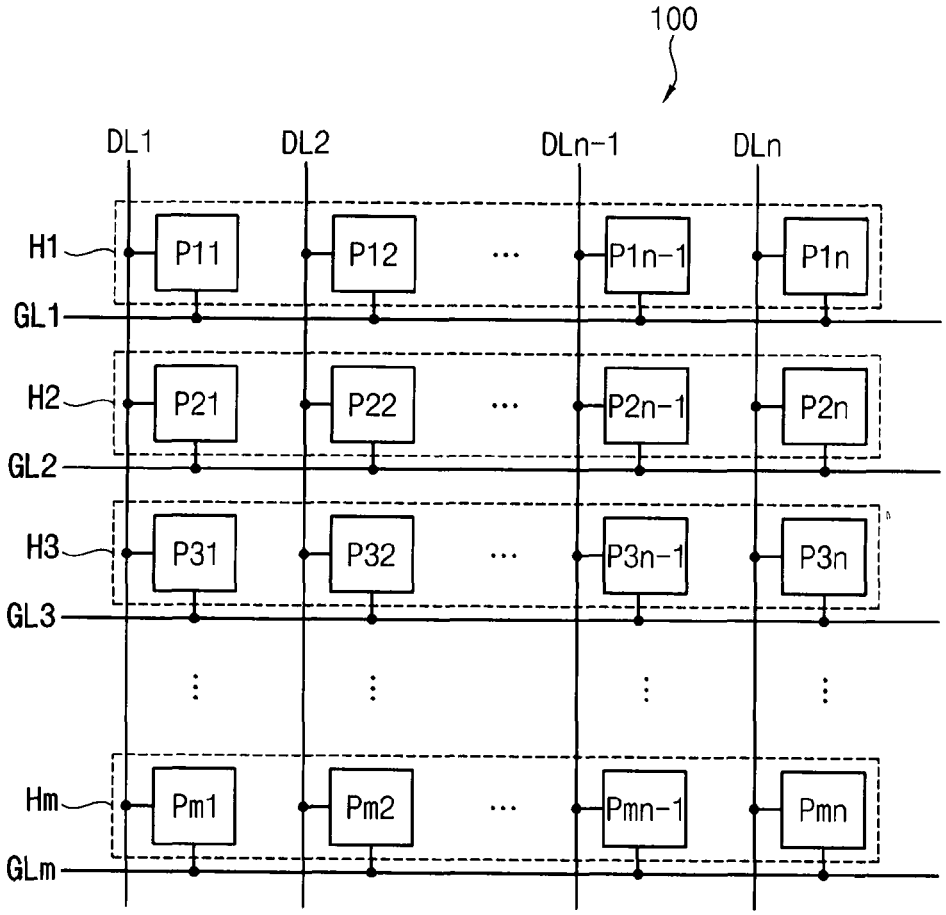
FIG. 2 is a diagram illustrating exemplary embodiments of a display panel included in a display apparatus according to the invention.

FIG. 2 is a diagram illustrating a display panel included in a display apparatus according to exemplary embodiments.

Referring to FIGS. 1 and 2, the display panel 100 includes first through m-th gate lines GL1, GL2, GL3, . . . , GLm extending in the first direction D1. The display panel 100 includes first through n-th data lines DL1, DL2, . . . , DLn−1, DLn extending in the second direction D2. The second data line DL2 may be adjacent to the first data line DL1.

The display panel 100 includes a plurality of pixels electrically connected to each of the first through m-th gate lines GL1, GL2, GL3, . . . , GLm and each of the first through n-th data lines DL1, DL2, . . . , DLn−1, DLn. The pixels may be arranged in an m by n matrix configuration, where m and n are natural numbers equal to or greater than two.

The display panel 100 includes a first pixel P11 electrically connected to the first gate line GL1 and the first data line DL1. The display panel 100 includes a second pixel P21 electrically connected to the second gate line GL2 and the first data line DL1. The second pixel P21 may be adjacent to the first pixel P11 in the second direction D2. The display panel 100 includes a third pixel P31 electrically connected to the third gate line GL3 and the first data line DL1. The third pixel P31 may be adjacent to the second pixel P21 in the second direction D2. The display panel 100 includes a fourth pixel P12 electrically connected to the first gate line GL1 and the second data line DL2. The display panel 100 includes a fifth pixel P22 electrically connected to the second gate line GL2 and the second data line DL2. The fifth pixel P22 may be adjacent to the fourth pixel P12 in the second direction D2. The display panel 100 includes a sixth pixel P32 electrically connected to the third gate line GL3 and the second data line DL2. The sixth pixel P32 may be adjacent to the fifth pixel P22 in the second direction D2.

The gate driver 300 may output a gate-on voltage to the first gate line GL1 during a first horizontal duration. Accordingly, the first pixel P11 and the fourth pixel P12 may be turned on during the first horizontal duration. The gate driver 300 may output the gate-on voltage to the second gate line GL2 during a second horizontal duration. Accordingly, the second pixel P21 and the fifth pixel P22 may be turned on during the second horizontal duration. The gate driver 300 may output the gate-on voltage to the third gate line GL3 during a third horizontal duration. Accordingly, the third pixel P31 and the sixth pixel P32 may be turned on during the third horizontal duration.

The display panel 100 may include a first pixel group P11 to P1*n* on a first horizontal line H1. The first horizontal line H1 may correspond to a first row of the m by n matrix. The first pixel group P11 to P1*n* may be connected to the first gate line GL1. The display panel 100 may include a second pixel group P21 to P2*n* on a second horizontal line H2. The second horizontal line H2 may correspond to a second row of the m by n matrix. The second horizontal line H2 may be adjacent to the first horizontal line H1 in the second direction D2. The second pixel group P21 to P2*n* may be connected to the second gate line GL2. The display panel 100 may include a third pixel group P31 to P3*n* on a third horizontal line H3. The third horizontal line H3 may correspond to a third row of the m by n matrix. The third horizontal line H3 may be adjacent to the second horizontal line H2 in the second direction D2. The third pixel group P31 to P3*n* may be connected to the third gate line GL3. The display panel 100 may include an m-th pixel group Pm1 to Pmn on an m-th horizontal line Hm. The m-th horizontal line Hm may correspond to an m-th row of the m by n matrix. The m-th pixel group Pm1 to Pmn may be connected to the m-th gate line GLm.

The first pixel group P11 to P1*n* may be turned on during the first horizontal duration. The second pixel group P21 to P2*n* may be turned on during the second horizontal duration. The third pixel group P31 to P3*n* may be turned on during the third horizontal duration.

Figure 3:
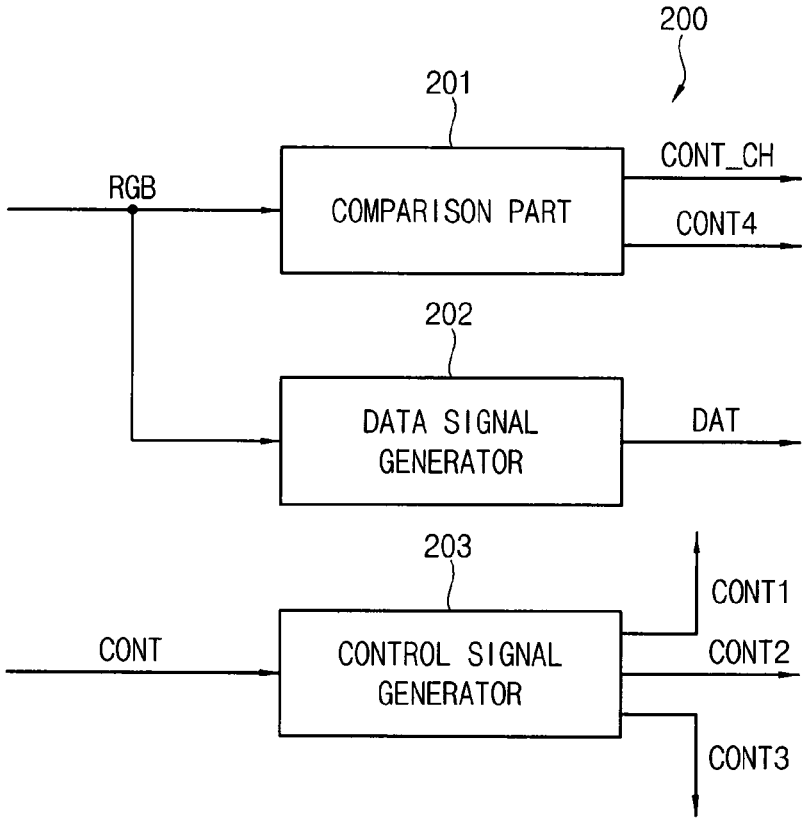
FIG. 3 is a block diagram illustrating exemplary embodiments of a timing controller included in a display apparatus according to the invention.

FIG. 3 is a block diagram illustrating a timing controller included in a display apparatus according to exemplary embodiments.

Referring to FIGS. 1 through 3, the timing controller 200 includes a comparison part 201, a data signal generator 202 and a control signal generator 203.

The comparison part 201 generates the external voltage selection signal CONT4 based on the input image data RGB. The comparison part 201 may generate the external voltage selection signal CONT4 based on input image data RGB corresponding to the first pixel group P11 to P1*n* of the display panel 100. The comparison part 201 may classify first data voltages corresponding to the input image data RGB corresponding to the first pixel group P11 to P1*n* as one of a plurality of voltage ranges. The comparison part 201 may count a number of the first data voltages included in each of the voltage ranges. The comparison part 201 may determine which voltage range among the voltage ranges includes a greatest number of first data voltages. The comparison part 201 generates the external voltage selection signal CONT4 based on the determination. The comparison part 201 outputs the external voltage selection signal CONT4 corresponding to the first pixel group P11 to P1*n*. The comparison part 201 may perform substantially the same operations to the second pixel group P21 to P2*n* through the m-th pixel group Pm1 to Pmn of the display panel 100 as above.

The comparison part 201 generates the channel control signal CONT_CH based on the input image data RGB. The comparison part 201 may compare input image data RGB corresponding to the first pixel P11 and input image data RGB corresponding to the second pixel P21. The comparison part 201 may compare the input image data RGB corresponding to the second pixel P21 and input image data RGB corresponding to the third pixel P31. The comparison part 201 may compare input image data RGB corresponding to the fourth pixel P12 and input image data RGB corresponding to the fifth pixel P22. The comparison part 201 may compare the input image data RGB corresponding to the fifth pixel P22 and input image data RGB corresponding to the sixth pixel P32. The comparison part 201 may compare the input image data RGB corresponding to the first pixel P11 and the input image data RGB corresponding to the fourth pixel P12. The comparison part 201 may compare the input image data RGB corresponding to the second pixel P21 and the input image data RGB corresponding to the fifth pixel P22. The comparison part 201 may compare the input image data RGB corresponding to the third pixel P31 and the input image data RGB corresponding to the sixth pixel P32. The comparison part 201 may generate the channel control signal CONT_CH based on the comparison. The comparison part 201 outputs the channel control signal CONT_CH to the data driver 500.

The external voltage selection signal CONT4 will be explained in detail with reference to FIGS. 4A and 4B. The channel control signal CONT_CH will be explained in detail with reference to FIGS. 5A through 5D.

The data signal generator 202 generates the data signal DAT based on the input image data RGB. The data signal generator 202 outputs the data signal DAT to the data driver 500.

The control signal generator 203 generates the first control signal CONT1, the second control signal CONT2 and the third control signal CONT3 based on the input control signal CONT. The control signal generator 203 outputs the first control signal CONT1 to the gate driver 300. The control signal generator 203 outputs the second control signal CONT2 to the data driver 500. The control signal generator 203 outputs the third control signal CONT3 to the gamma reference voltage generator 400.

Figure 4A:
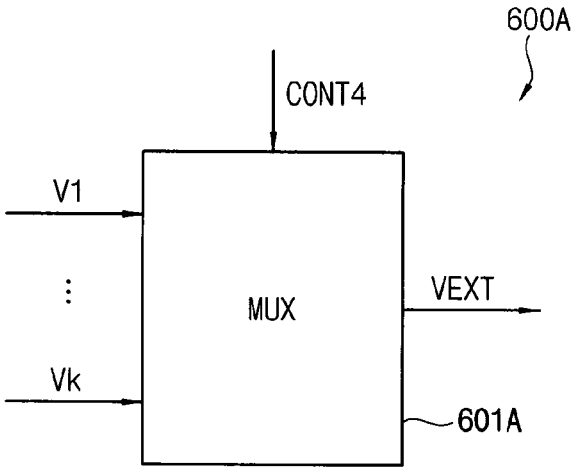
FIGS. 4A and 4B are block diagrams illustrating exemplary embodiments of an external voltage generator included in a display apparatus according to the invention.
Figure 4B:
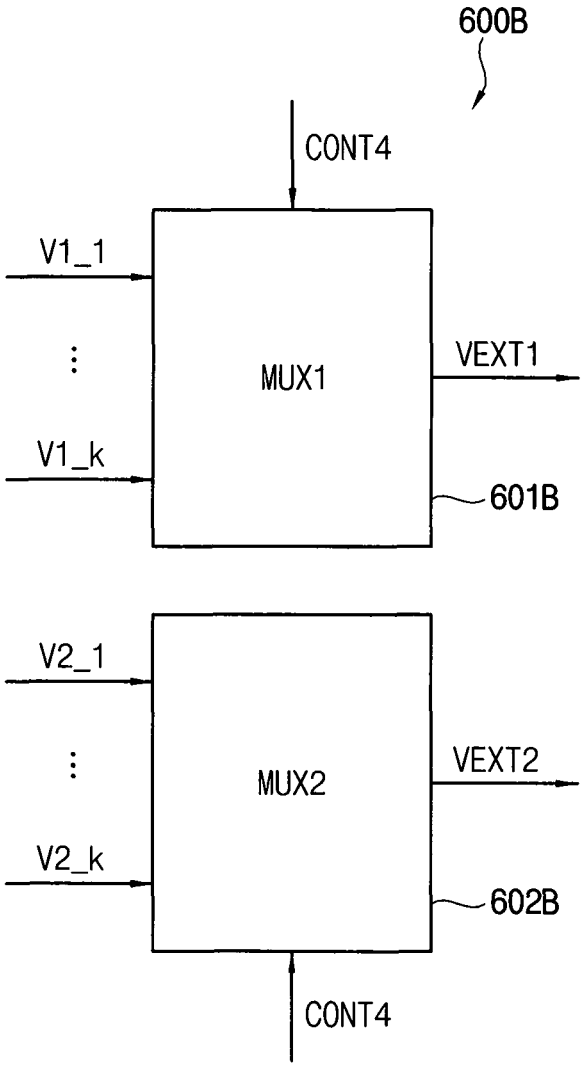

FIGS. 4A and 4B are block diagrams illustrating examples of an external voltage generator included in a display apparatus according to exemplary embodiments.

Referring to FIGS. 1 through 3 and 4A, an external voltage generator 600A selects one of voltage levels V1 to Vk based on the external voltage selection signal CONT4. Here, k is a natural number greater than or equal to two. In an exemplary embodiment, k may be greater than or equal to two and smaller than or equal to sixteen, for example. Each of the voltage levels V1 to Vk may be a level of data voltage generated by the data driver 500. In an exemplary embodiment, each of the voltage levels V1 to Vk may be a level between a power supply voltage AVDD (refer to FIGS. 6A to 6D) and a ground voltage GND (refer to FIGS. 6A to 6D), for example. The external voltage generator 600A may include a k to 1 (i.e., k data inputs to one data output) multiplexer ("MUX") 601A. In an exemplary embodiment, k may be greater than or equal to two and smaller than or equal to sixteen, for example.

The external voltage generator 600A selects a first selection level among the voltage levels V1 to Vk corresponding to the first pixel group P11 to P1*n* based on the external voltage selection signal CONT4. The first selection level may correspond to a voltage range including a greatest number of first data voltages among the voltage ranges. The external voltage generator 600A generates an external voltage VEXT having the first selection level. The external voltage generator 600A outputs the external voltage VEXT to the data driver 500 during the first horizontal duration.

The external voltage generator 600A may perform substantially the same operations to the second pixel group P21 to P2*n* through the m-th pixel group Pm1 to Pmn of the display panel 100 as above. In an exemplary embodiment, the external voltage generator 600A may generate a second external voltage having a second selection level corresponding to the second pixel group P21 to P2*n*, and output the second external voltage to the data driver 500 during the second horizontal duration. The external voltage generator 600A may generate a third external voltage having a third selection level corresponding to the third pixel group P31 to P3*n*, and output the third external voltage to the data driver 500 during the third horizontal duration.

Referring to FIGS. 1 through 3 and 4B, an external voltage generator 600B selects one of first voltage levels V1_1 to V1_*k* and one of second voltage levels V2_1 to V2_*k* based on the external voltage selection signal CONT4. Here, k is a natural number greater than or equal to two. In an exemplary embodiment, k may be greater than or equal to two and smaller than or equal to sixteen, for example. Each of the first and second voltage levels V1_1 to V1_*k* and V2_1 to V2_*k* may be a level of data voltage generated by the data driver 500. In an exemplary embodiment, each of the first and second voltage levels V1_1 to V1_*k* and V2_1 to V2_*k* may be a level between a power supply voltage AVDD (refer to FIGS. 6A to 6D) and a ground voltage GND (refer to FIGS. 6A to 6D), for example. The external voltage generator 600B may include a first k to 1 MUX 601B and a second k to 1 MUX 602B. In an exemplary embodiment, k may be greater than or equal to two and smaller than or equal to sixteen, for example.

The external voltage generator 600B selects a first selection level among the first voltage levels V1_1 to V1_*k* and a second selection level among the second voltage levels V2_1 to V2_*k* corresponding to the first pixel group P11 to P1*n* based on the external voltage selection signal CONT4. The first selection level may correspond to a voltage range including a greatest number of first data voltages among the voltage ranges. The second selection level may correspond to a voltage range including a second greatest number of first data voltages among the voltage ranges. In an alternative exemplary embodiment, the second selection level may have a same absolute value and a different polarity with the first selection level. The external voltage generator 600B generates a first external voltage VEXT1 having the first selection level and a second external voltage VEXT2 having the second selection level. The polarity of the first external voltage VEXT1 may be opposite to the polarity of the second external voltage VEXT2. The external voltage generator 600B outputs the first and second external voltages VEXT1, VEXT2 to the data driver 500 during the first horizontal duration.

The external voltage generator 600B may perform substantially the same operations to the second pixel group P21 to P2*n* through the m-th pixel group Pm1 to Pmn of the display panel 100 as above. In an exemplary embodiment, the external voltage generator 600B may generate third and fourth external voltages having third and fourth selection levels corresponding to the second pixel group P21 to P2*n*, and output the third and fourth external voltages to the data driver 500 during the second horizontal duration. The external voltage generator 600B may generate fifth and sixth external voltages having fifth and sixth selection levels corresponding to the third pixel group P31 to P3*n*, and output the fifth and sixth external voltages to the data driver 500 during the third horizontal duration.

FIGS. 5A, 5B, 5C and 5D are diagrams illustrating examples of a data driver included in a display apparatus according to exemplary embodiments. Any repetitive explanation will be omitted.

Referring to FIGS. 1 through 3, 4A and 5A, a data driver 500A includes a channel voltage generator 501, a first channel line CHL1, a first switch SW1_1 and a second switch SW1_2.

The channel voltage generator 501 generates a first channel voltage VCH1 corresponding to the first pixel P11 of the display panel 100 based on the data signal DAT. The channel voltage generator 501 outputs the first channel voltage VCH1 to the first channel line CHL1 during the first horizontal duration.

The first channel line CHL1 is connected to the first data line DL1. The first switch SW1_1 includes a first electrode receiving the first channel voltage VCH1 during the first horizontal duration and a second electrode connected to the first channel line CHL1. The second switch SW1_2 includes a third electrode receiving the external voltage VEXT during the first horizontal duration and a fourth electrode connected to the first channel line CHL1.

The data driver 500A controls operations of the first and second switches SW1_1, SW1_2 based on a channel control signal CONT_CHA. In an exemplary embodiment, the data driver 500A turns on the first switch SW1_1 during the first horizontal duration, and turns off the second switch SW1_2 during the first horizontal duration, for example. In an alternative exemplary embodiment, the data driver 500A turns off the first switch SW1_1 during an early part of the first horizontal duration, and turns on the second switch SW1_2 during the early part of the first horizontal duration.

The data driver 500A may further include a second channel line CHL2, a third switch SW2_1 and a fourth switch SW2_2.

The channel voltage generator 501 may further generate a second channel voltage VCH2 corresponding to the fourth pixel P12 of the display panel 100 based on the data signal DAT. The channel voltage generator 501 may further output the second channel voltage VCH2 to the second channel line CHL2 during the first horizontal duration.

The second channel line CHL2 may be connected to the second data line DL2. The second channel line CHL2 may be adjacent to the first channel line CHL1 in the first direction D1. The third switch SW2_1 includes a fifth electrode receiving the second channel voltage VCH2 during the first horizontal duration and a sixth electrode connected to the second channel line CHL2. The fourth switch SW2_2 includes a seventh electrode receiving the external voltage VEXT during the first horizontal duration and an eighth electrode connected to the second channel line CHL2.

The data driver 500A controls operations of the third and fourth switches SW2_1, SW2_2 based on the channel control signal CONT_CHA. In an exemplary embodiment, the data driver 500A turns on the third switch SW2_1 during the first horizontal duration, and turns off the fourth switch SW2_2 during the first horizontal duration, for example. In an alternative exemplary embodiment, the data driver 500A turns off the third switch SW2_1 during the early part of the first horizontal duration, and turns on the fourth switch SW2_2 during the early part of the first horizontal duration.

Referring to FIGS. 1 through 3, 4B and 5B, a data driver 500B includes a channel voltage generator 501, a first channel line CHL1, a first switch SW1_1 and a second switch SW1_2. The data driver 500B may further include a third switch SW1_3.

The third switch SW1_3 may include a fifth electrode receiving the second external voltage VEXT2 during the first horizontal duration and a sixth electrode connected to the first channel line CHL1.

The data driver 500B may control operations of the first, second and third switches SW1_1, SW1_2, SW1_3 based on a channel control signal CONT_CHB. In an exemplary embodiment, the data driver 500B turns on the first switch SW1_1 during the first horizontal duration, and turns off the second and third switches SW1_2, SW1_3 during the first horizontal duration, for example. In an alternative exemplary embodiment, the data driver 500B turns off the first and third switches SW1_1, SW1_3 during an early part of the first horizontal duration, and turns on the second switch SW1_2 during the early part of the first horizontal duration. In an alternative exemplary embodiment, the data driver 500B turns off the first and second switches SW1_1, SW1_2 during the early part of the first horizontal duration, and turns on the third switch SW1_3 during the early part of the first horizontal duration.

Referring to FIGS. 1 through 3, 4A and 5C, a data driver 500C includes a channel voltage generator 501, a first channel line CHL1, a first switch SW1_1 and a second switch SW1_2. The data driver 500C may further include a fourth switch SW12.

The fourth switch SW12 may include a seventh electrode connected to the first channel line CHL1 and an eighth electrode connected to the second channel line CHL2.

The data driver 500C may control operations of the first, second and fourth switches SW1_1, SW1_2, SW12 based on a channel control signal CONT_CHC. In an exemplary embodiment, the data driver 500C turns on the first switch SW1_1 during the first horizontal duration, and turns off the second and fourth switches SW1_2, SW12 during the first horizontal duration, for example. In an alternative exemplary embodiment, the data driver 500C turns off the first and fourth switches SW1_1, SW12 during an early part of the first horizontal duration, and turns on the second switch SW1_2 during the early part of the first horizontal duration. In an alternative exemplary embodiment, the data driver 500C turns off the first and second switches SW1_1, SW1_2 during the early part of the first horizontal duration, and turns on the fourth switch SW12 during the early part of the first horizontal duration.

Referring to FIGS. 1 through 3, 4B and 5D, a data driver 500D includes a channel voltage generator 501, a first channel line CHL1, a first switch SW1_1 and a second switch SW1_2. The data driver 500D may further include third and fourth switches SW1_3, SW12.

The third switch SW1_3 may include a fifth electrode receiving the second external voltage VEXT2 during the first horizontal duration and a sixth electrode connected to the first channel line CHL1. The fourth switch SW12 may include a seventh electrode connected to the first channel line CHL1 and an eighth electrode connected to the second channel line CHL2.

The data driver 500D may control operations of the first, second, third and fourth switches SW1_1, SW1_2, SW1_3, SW12 based on a channel control signal CONT_CHD. In an exemplary embodiment, the data driver 500D turns on the first switch SW1_1 during the first horizontal duration, and turns off the second, third and fourth switches SW1_2, SW1_3, SW12 during the first horizontal duration, for example. In an alternative exemplary embodiment, the data driver 500D turns off the first, third and fourth switches SW1_1, SW1_3, SW12 during an early part of the first horizontal duration, and turns on the second switch SW1_2 during the early part of the first horizontal duration. In an alternative exemplary embodiment, the data driver 500D turns off the first, second and fourth switches SW1_1, SW1_2, SW12 during the early part of the first horizontal duration, and turns on the third switch SW1_3 during the early part of the first horizontal duration. In an alternative exemplary embodiment, the data driver 500D turns off the first, second and third switches SW1_1, SW1_2, SW1_3 during the early part of the first horizontal duration, and turns on the fourth switch SW12 during the early part of the first horizontal duration.

Figure 5A:
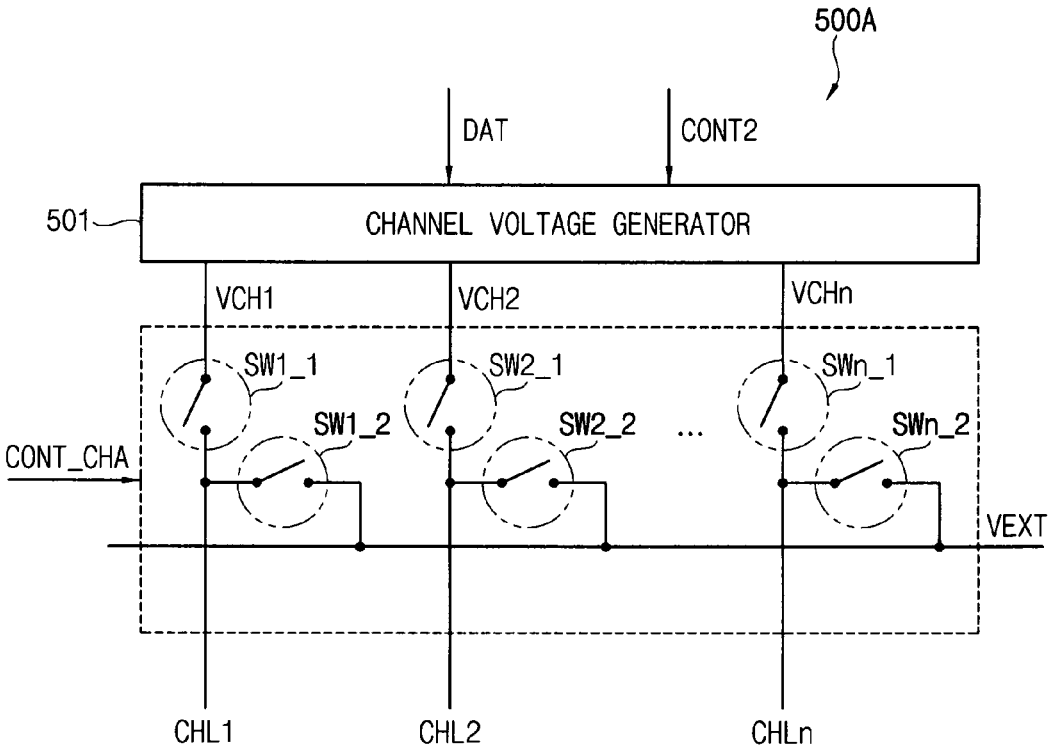
FIGS. 5A, 5B, 5C and 5D are diagrams illustrating exemplary embodiments of a data driver included in a display apparatus according to the invention.
Figure 5B:
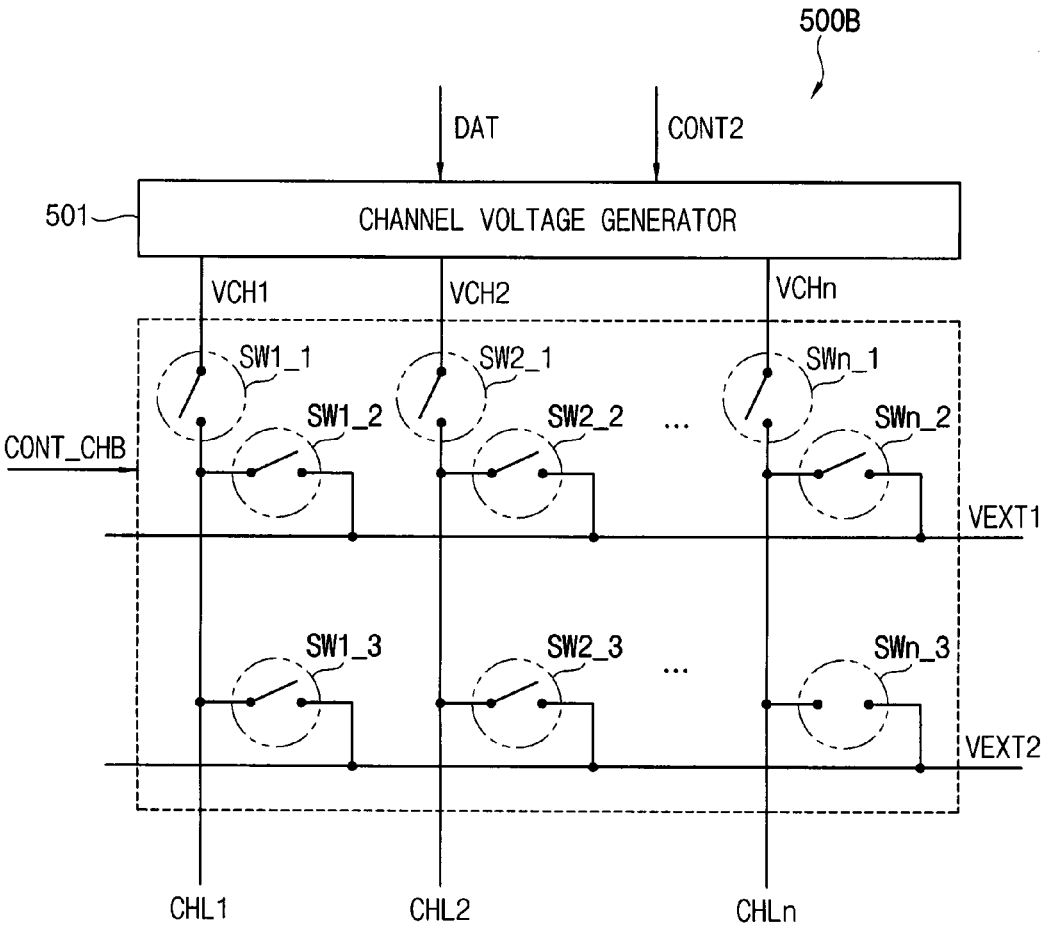
Figure 5C:
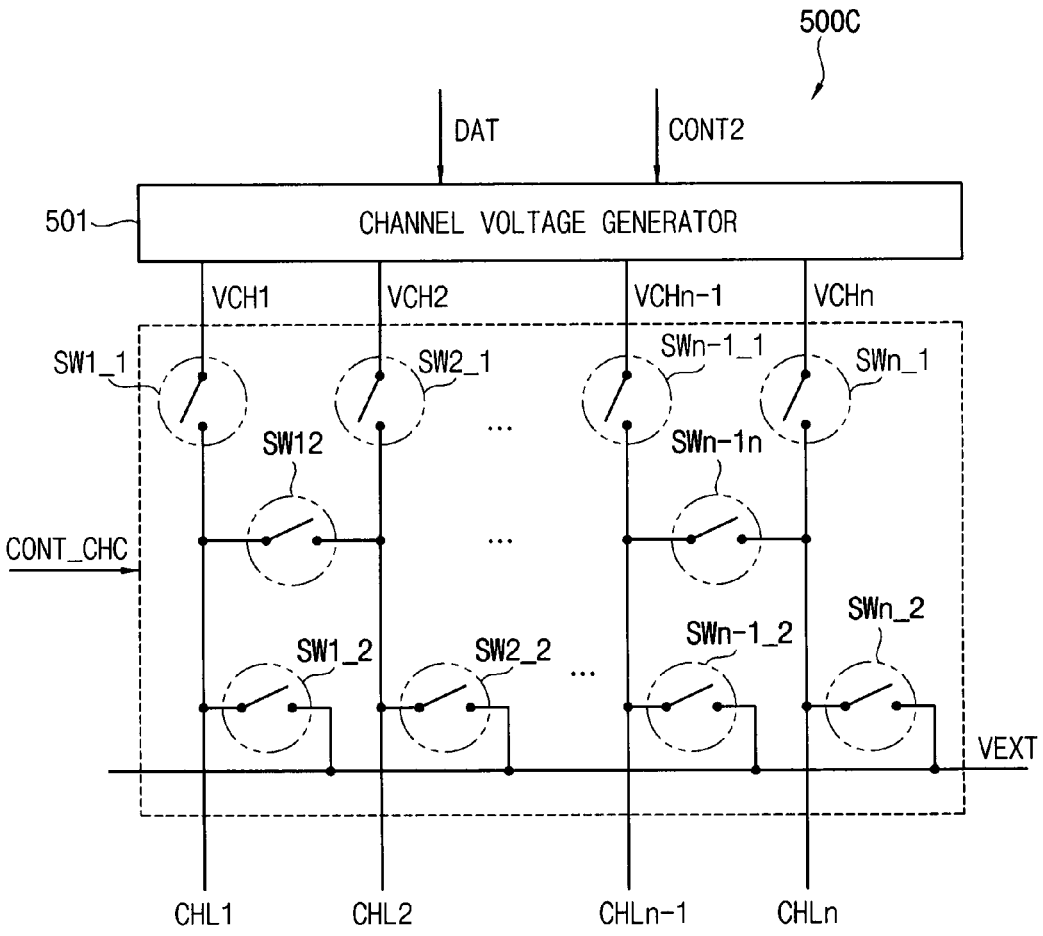
Figure 5D:
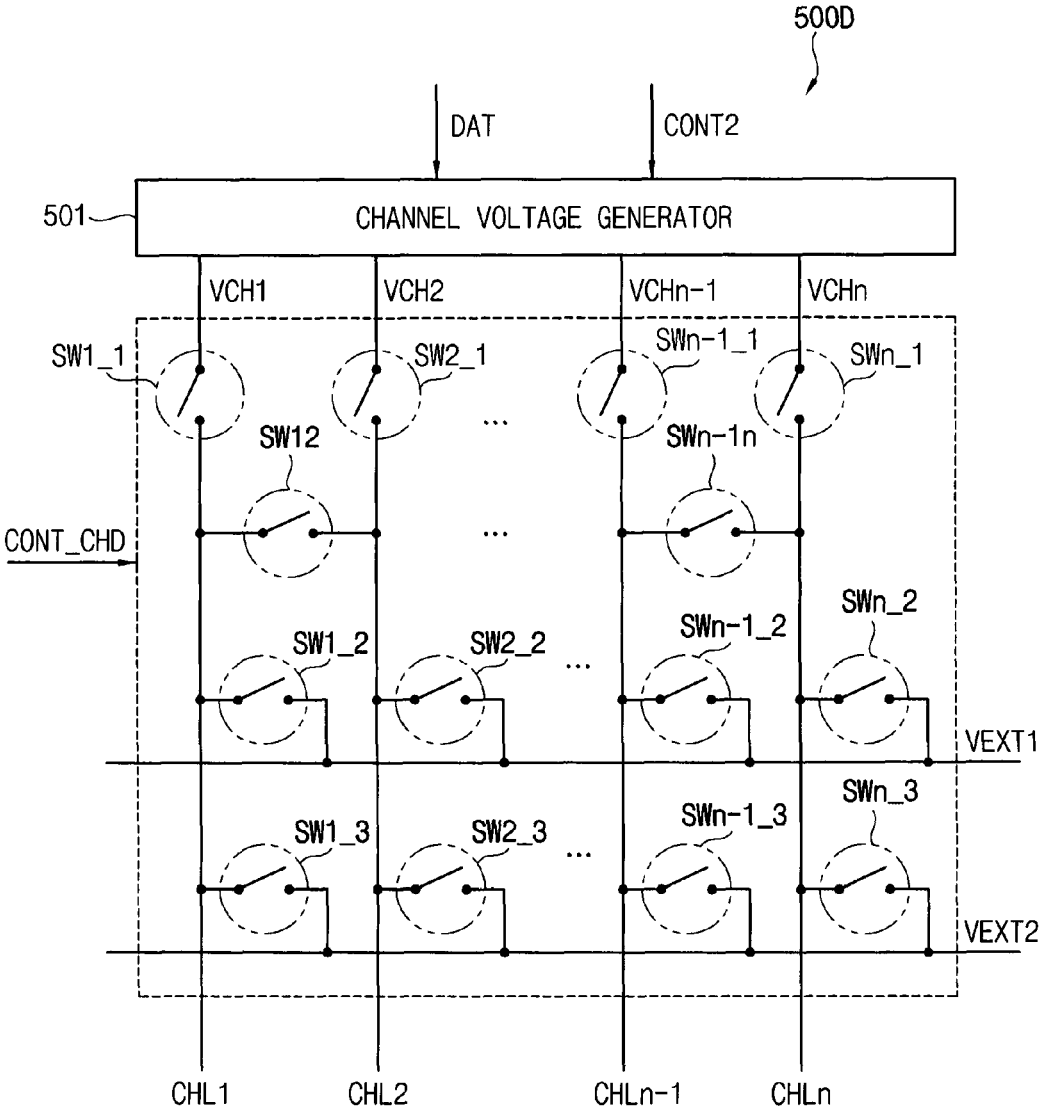
Figure 6A:
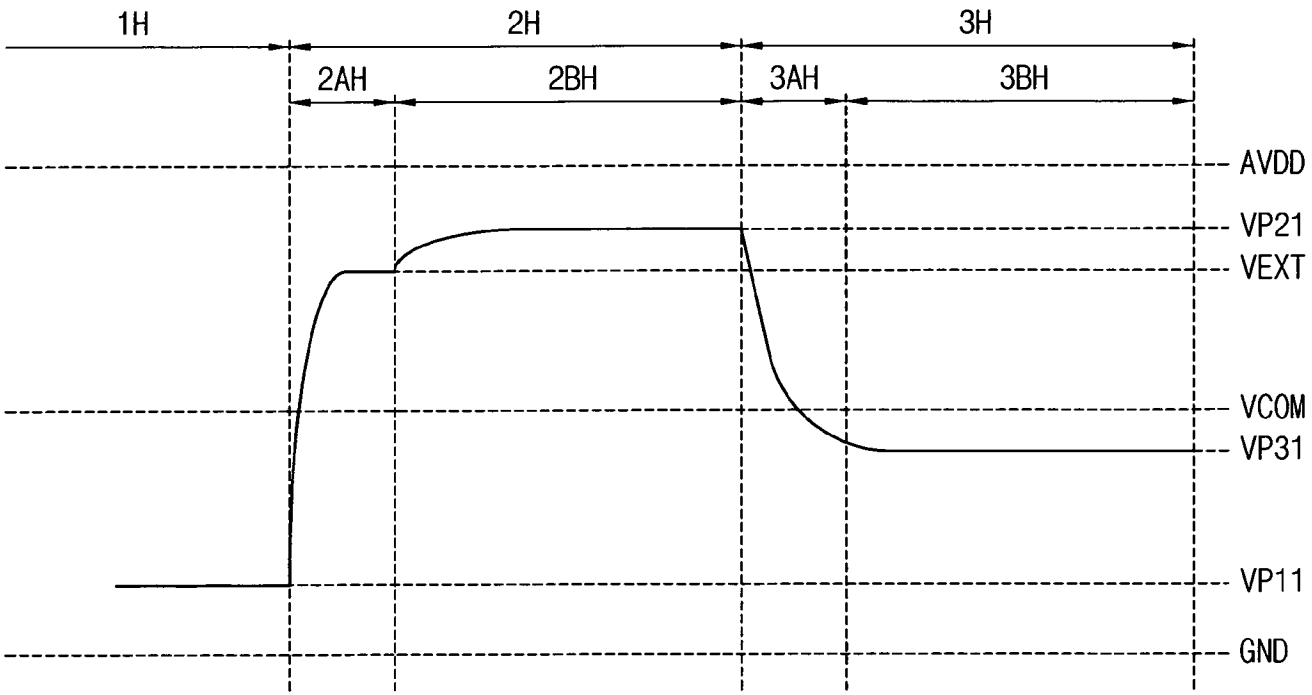
FIG. 6A is a diagram illustrating exemplary embodiments of data voltages generated by a data driver illustrated in FIG. 5A according to the invention.
Figure 6B:
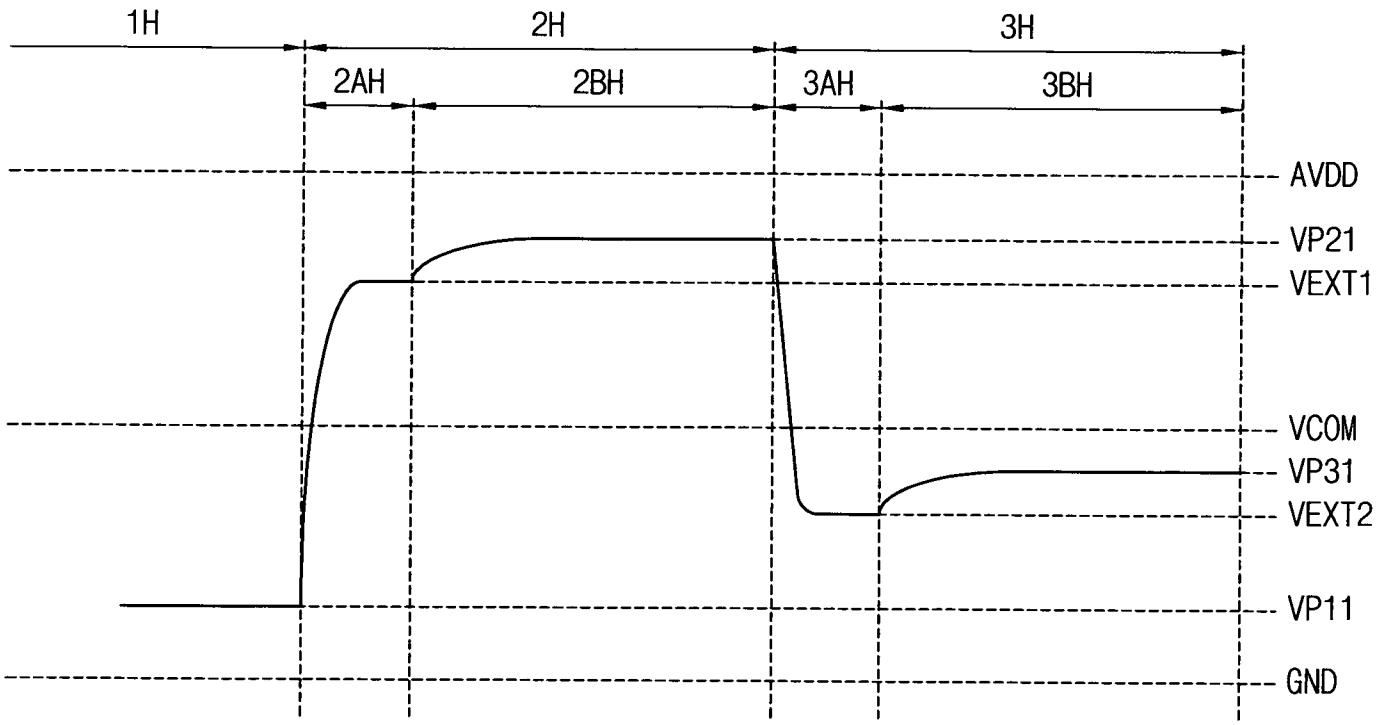
FIG. 6B is a diagram illustrating exemplary embodiments of data voltages generated by a data driver illustrated in FIG. 5B according to the invention.
Figure 6C:
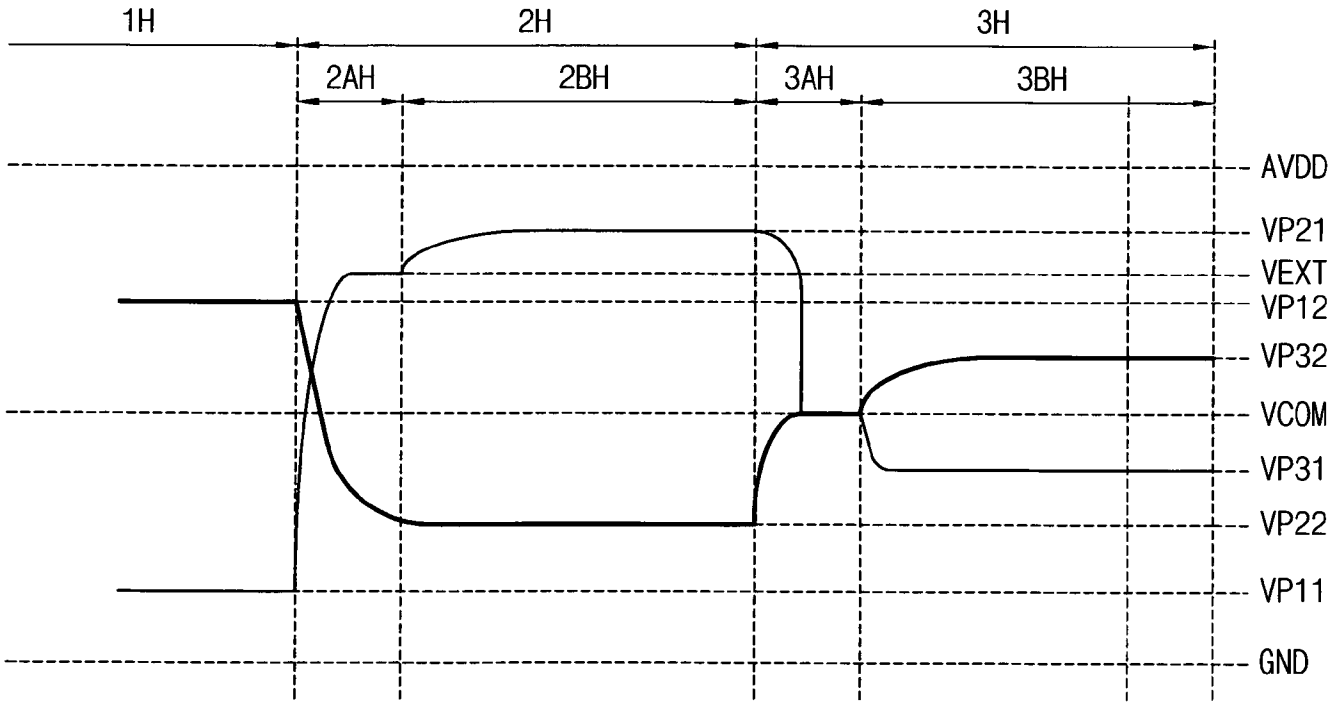
FIG. 6C is a diagram illustrating exemplary embodiments of data voltages generated by a data driver illustrated in FIG. 5C according to the invention.
Figure 6D:
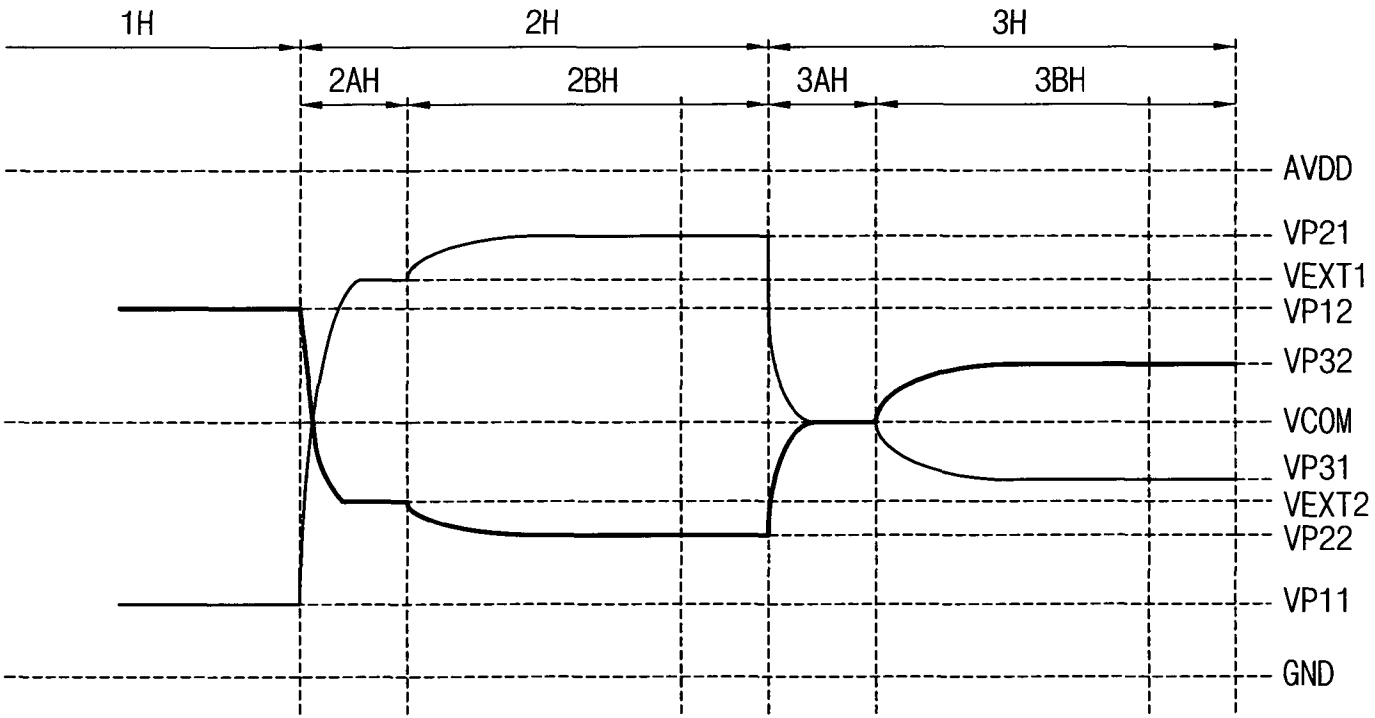
FIG. 6D is a diagram illustrating exemplary embodiments of data voltages generated by a data driver illustrated in FIG. 5D according to the invention.

FIG. 6A is a diagram illustrating an example of data voltages generated by a data driver illustrated in FIG. 5A according to exemplary embodiments. FIG. 6B is a diagram illustrating an example of data voltages generated by a data driver illustrated in FIG. 5B according to exemplary embodiments. FIG. 6C is a diagram illustrating an example of data voltages generated by a data driver illustrated in FIG. 5C according to exemplary embodiments. FIG. 6D is a diagram illustrating an example of data voltages generated by a data driver illustrated in FIG. 5D according to exemplary embodiments.

Referring to FIGS. 1 through 3, 4A, 5A and 6A, FIG. 6A is a diagram illustrating data voltages charged to first through third pixels P11, P21, P31 of FIG. 2 during first through third horizontal durations 1H, 2H, 3H.

The first pixel P11 is turned on during the first horizontal duration 1H. A first channel voltage VP11 is charged to the first pixel P11 during the first horizontal duration 1H.

The second pixel P21 is turned on during the second horizontal duration 2H.

The external voltage generator 600A selects a first selection level among the voltage levels V1 to Vk corresponding to the second pixel group P21 to P2*n*. The external voltage generator 600A generates an external voltage VEXT having the first selection level. The external voltage generator 600A outputs the external voltage VEXT to the data driver 500A during the second horizontal duration 2H.

The channel voltage generator 501 generates a second channel voltage VP21 corresponding to the second pixel P21 based on the data signal DAT. The data driver 500A controls operations of the first and second switches SW1_1, SW1_2 based on the channel control signal CONT_CHA. The data driver 500A turns off the first switch SW1_1 during an early part of the second horizontal duration 2AH, and turns on the second switch SW1_2 during the early part of the second horizontal duration 2AH. The external voltage VEXT is charged to the second pixel P21 during the early part of the second horizontal duration 2AH. The data driver 500A turns on the first switch SW1_1 during a latter part of the second horizontal duration 2BH, and turns off the second switch SW1_2 during the latter part of the second horizontal duration 2BH. The second channel voltage VP21 is charged to the second pixel P21 during the latter part of the second horizontal duration 2BH.

The third pixel P31 is turned on during the third duration 3H.

The channel voltage generator 501 generates a third channel voltage VP31 corresponding to the third pixel P31 based on the data signal DAT. The data driver 500A controls operations of the first and second switches SW1_1, SW1_2 based on the channel control signal CONT_CHA. The data driver 500A turns on the first switch SW1_1 during the third horizontal duration 3H, and turns off the second switch SW1_2 during the third horizontal duration 3H. The third channel voltage VP31 is charged to the third pixel P31 during the third horizontal duration 3H.

Referring to FIGS. 1 through 3, 4B, 5B and 6B, FIG. 6B is a diagram illustrating data voltages charged to first through third pixels P11, P21, P31 of FIG. 2 during first through third horizontal durations 1H, 2H, 3H.

The first pixel P11 is turned on during the first horizontal duration 1H. A first channel voltage VP11 is charged to the first pixel P11 during the first horizontal duration 1H.

The second pixel P21 is turned on during the second horizontal duration 2H.

The first MUX 601B selects a first selection level among the voltage levels V1_1 to V1_*k* corresponding to the second pixel group P21 to P2*n*. The first MUX 601B generates a first external voltage VEXT1 having the first selection level. The first MUX 601B outputs the first external voltage VEXT1 to the data driver 500B during the second horizontal duration 2H.

The channel voltage generator 501 generates a second channel voltage VP21 corresponding to the second pixel P21 based on the data signal DAT. The data driver 500B controls operations of the first, second and third switches SW1_1, SW1_2, SW1_3 based on the channel control signal CONT_CHB. The data driver 500B turns off the first and third switches SW1_1, SW1_3 during an early part of the second horizontal duration 2AH, and turns on the second switch SW1_2 during the early part of the second horizontal duration 2AH. The first external voltage VEXT1 is charged to the second pixel P21 during the early part of the second horizontal duration 2AH. The data driver 500B turns on the first switch SW1_1 during a latter part of the second horizontal duration 2BH, and turns off the second and third switches SW1_2, SW1_3 during the latter part of the second horizontal duration 2BH. The second channel voltage VP21 is charged to the second pixel P21 during the latter part of the second horizontal duration 2BH.

The third pixel P31 is turned on during the third duration 3H.

The second MUX 602B selects a second selection level among the voltage levels V2_1 to V2_*k* corresponding to the third pixel group P31 to P3*n*. The second MUX 602B generates a second external voltage VEXT2 having the second selection level. The second MUX 602B outputs the second external voltage VEXT2 to the data driver 500B during the third horizontal duration 3H.

The channel voltage generator 501 generates a third channel voltage VP31 corresponding to the third pixel P31 based on the data signal DAT. The data driver 500B controls operations of the first, second and third switches SW1_1, SW1_2, SW1_3 based on the channel control signal CONT_CHB. The data driver 500B turns off the first and second switches SW1_1, SW1_2 during an early part of the third horizontal duration 3AH, and turns on the third switch SW1_3 during the early part of the third horizontal duration 3AH. The second external voltage VEXT2 is charged to the third pixel P31 during the early part of the third horizontal duration 3AH. The data driver 500B turns off the second and third switches SW1_2, SW1_3 during a latter part of the third horizontal duration 3BH, and turns on the first switch SW1_1 during the latter part of the third horizontal duration 3BH. The third channel voltage VP31 is charged to the third pixel P31 during the latter part of the third horizontal duration 3BH.

Referring to FIGS. 1 through 3, 4A, 5C and 6C, FIG. 6C is a diagram illustrating data voltages charged to first through sixth pixels P11, P21, P31, P12, P22, P32 of FIG. 2 during first through third horizontal durations 1H, 2H, 3H.

The first pixel P11 and the fourth pixel P12 are turned on during the first horizontal duration 1H. A first channel voltage VP11 is charged to the first pixel P11 during the first horizontal duration 1H. A fourth channel voltage VP12 is charged to the fourth pixel P12 during the first horizontal duration 1H.

The second pixel P21 and the fifth pixel P22 are turned on during the second horizontal duration 2H.

The external voltage generator 600A selects a first selection level among the voltage levels V1 to Vk corresponding to the second pixel group P21 to P2*n*. The external voltage generator 600A generates an external voltage VEXT having the first selection level. The external voltage generator 600A outputs the external voltage VEXT to the data driver 500C during the second horizontal duration 2H.

The channel voltage generator 501 generates a second channel voltage VP21 corresponding to the second pixel P21 based on the data signal DAT. The channel voltage generator 501 generates a fifth channel voltage VP22 corresponding to the fifth pixel P22 based on the data signal DAT. The data driver 500C controls operations of the first, second, fourth, fifth and sixth switches SW1_1, SW1_2, SW12, SW2_1, SW2_2 based on the channel control signal CONT_CHC. The data driver 500C turns off the first, fourth and sixth switches SW1_1, SW12, SW2_2 during an early part of the second horizontal duration 2AH, and turns on the second and fifth switches SW1_2, SW2_1 during the early part of the second horizontal duration 2AH. The external voltage VEXT is charged to the second pixel P21 during the early part of the second horizontal duration 2AH. The fifth channel voltage VP22 is charged to the fifth pixel P22 during the early part of the second horizontal duration 2AH. The data driver 500C turns on the first and fifth switches SW1_1, SW2_1 during a latter part of the second horizontal duration 2BH, and turns off the second, fourth and sixth switches SW1_2, SW12, SW2_2 during the latter part of the second horizontal duration 2BH. The second channel voltage VP21 is charged to the second pixel P21 during the latter part of the second horizontal duration 2BH. The fifth channel voltage VP22 is charged to the fifth pixel P22 during the latter part the second horizontal duration 2BH.

The third pixel P31 and the sixth pixel P32 are turned on during the third duration 3H.

The channel voltage generator 501 generates a third channel voltage VP31 corresponding to the third pixel P31 based on the data signal DAT. The channel voltage generator 501 generates a sixth channel voltage VP32 corresponding to the sixth pixel P32 based on the data signal DAT. The data driver 500C controls operations of the first, second, fourth, fifth and sixth switches SW1_1, SW1_2, SW12, SW2_1, SW2_2 based on the channel control signal CONT_CHC. The data driver 500C turns on the fourth switch SW12 during an early part of the third horizontal duration 3AH, and turns off the first, second, fifth and sixth switches SW1_1, SW1_2, SW2_1, SW2_2 during the early part of the third horizontal duration 3AH. A common voltage VCOM may be charged to the third pixel P31 and the sixth pixel P32 during the early part of the third horizontal duration 3AH. The data driver 500C turns on the first and fifth switches SW1_1, SW2_1 during a latter part of the third horizontal duration 3BH, and turns off the second, fourth and sixth switches SW1_2, SW12, SW2_2, SW2_2 during the latter part of the third horizontal duration 3BH. The third channel voltage VP31 is charged to the third pixel P31. The sixth channel voltage VP32 is charged to the sixth pixel P32 during the latter part of the third horizontal duration 3BH.

Referring to FIGS. 1 through 3, 4B, 5D and 6D, FIG. 6D is a diagram illustrating data voltages charged to first through sixth pixels P11, P21, P31, P12, P22, P32 of FIG. 2 during first through third horizontal durations 1H, 2H, 3H.

The first pixel P11 and the fourth pixel P12 are turned on during the first horizontal duration 1H. A first channel voltage VP11 is charged to the first pixel P11 during the first horizontal duration 1H. A fourth channel voltage VP12 is charged to the fourth pixel P12 during the first horizontal duration 1H.

The second pixel P21 and the fifth pixel P22 are turned on during the second horizontal duration 2H.

The first MUX 601B selects a first selection level among the voltage levels V1_1 to V1_*k* corresponding to the second pixel group P21 to P2*n*. The first MUX 601B generates a first external voltage VEXT1 having the first selection level. The first MUX 601B outputs the first external voltage VEXT1 to the data driver 500D during the second horizontal duration 2H.

The second MUX 602B selects a second selection level among the voltage levels V2_1 to V2_*k* corresponding to the second pixel group P21 to P2*n*. The second MUX 602B generates a second external voltage VEXT2 having the second selection level. The second MUX 602B outputs the second external voltage VEXT2 to the data driver 500D during the second horizontal duration 2H.

The channel voltage generator 501 generates a second channel voltage VP21 corresponding to the second pixel P21 based on the data signal DAT. The channel voltage generator 501 generates a fifth channel voltage VP22 corresponding to the fifth pixel P22 based on the data signal DAT. The data driver 500D controls operations of the first, second, third, fourth, fifth, sixth and seventh switches SW1_1, SW1_2, SW1_3, SW12, SW2_1, SW2_2, SW2_3 based on the channel control signal CONT_CHD. The data driver 500D turns off the first, third, fourth, fifth and sixth switches SW1_1, SW1_3, SW12, SW2_1, SW2_2 during an early part of the second horizontal duration 2AH, and turns on the second and seventh switches SW1_2, SW2_3 during the early part of the second horizontal duration 2AH. The first external voltage VEXT1 is charged to the second pixel P21 during the early part of the second horizontal duration 2AH. The second external voltage VEXT2 is charged to the fifth pixel P22 during the early part of the second horizontal duration 2AH. The data driver 500D turns on the first and fifth switches SW1_1, SW2_1 during a latter part of the second horizontal duration 2BH, and turns off the second, third, fourth, sixth and seventh switches SW1_2, SW1_3, SW12, SW2_2, SW2_3 during the latter part of the second horizontal duration 2BH. The second channel voltage VP21 is charged to the second pixel P21 during the latter part of the second horizontal duration 2BH. The fifth channel voltage VP22 is charged to the fifth pixel P22 during the latter part of the second horizontal duration 2BH.

The third pixel P31 and the sixth pixel P32 are turned on during the third duration 3H.

The channel voltage generator 501 generates a third channel voltage VP31 corresponding to the third pixel P31 based on the data signal DAT. The channel voltage generator 501 generates a sixth channel voltage VP32 corresponding to the sixth pixel P32 based on the data signal DAT. The data driver 500D controls operations of the first, second, third, fourth, fifth, sixth and seventh switches SW1_1, SW1_2, SW1_3, SW12, SW2_1, SW2_2, SW2_3 based on the channel control signal CONT_CHD. The data driver 500D turns off the first, second, third, fifth, sixth and seventh switches SW1_1, SW1_2, SW1_3, SW2_1, SW2_2, SW2_3 during an early part of the third horizontal duration 3AH, and turns on the fourth switch SW12 during the early part of the third horizontal duration 3AH. A common voltage VCOM may be charged to the third pixel P31 and the sixth pixel P32 during the early part of the third horizontal duration 3AH. The data driver 500D turns on the first and fifth switches SW1_1, SW2_1 during a latter part of the third horizontal duration 3BH, and turns off the second, third, fourth, sixth and seventh switches SW1_2, SW1_3, SW12, SW2_2, SW2_3 during the latter part of the third horizontal duration 3BH. The third channel voltage VP31 is charged to the third pixel P31 during the latter part of the third horizontal duration 3BH. The sixth channel voltage VP32 is charged to the sixth pixel P32 during the latter part of the third horizontal duration 3BH.

The above described embodiments may be used in various types of display apparatuses and/or a system including the display apparatuses, such as a mobile phone, a smart phone, a PDA, a PMP, a digital camera, a digital television, a set-top box, a music player, a portable game console, a navigation device, a personal computer ("PC"), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a display panel comprising a first data line and a first pixel group comprising a first pixel connected to the first data line and disposed on a first horizontal line;

a timing controller which generates an external voltage selection signal, a channel control signal and a data signal based on input image data;

an external voltage generator which selects one of first voltage levels based on the external voltage selection signal to generate a first external voltage having a first selection level corresponding to the first horizontal line; and a data driver comprising:

a channel voltage generator which generates a first channel voltage corresponding to the first pixel based on the data signal;

a first channel line connected to the first data line;

a first switch connected between a first node which receives the first channel voltage and a second node connected to the first channel line; and a second switch connected between a third node which receives the first external voltage and a fourth node connected to the first channel line, wherein the data driver controls operations of the first and second switches based on the channel control signal wherein the timing controller generates the external voltage selection signal based on first input image data corresponding to pixels included in the first pixel group and disposed on the first horizontal line, wherein each of data voltages corresponding to the first input image data is classified to one of voltage ranges, and wherein the first selection level corresponding to a first voltage range is selected based on the external voltage selection signal, the first voltage range among the voltage ranges including a greatest number of the data voltages.

2. The display apparatus of claim 1, wherein the external voltage generator further selects one of second voltage levels based on the external voltage selection signal to generate a second external voltage having a second selection level.

3. The display apparatus of claim 2, wherein a polarity of the first external voltage is substantially opposite to a polarity of the second external voltage.

4. The display apparatus of claim 2, wherein the data driver further comprises:

a third switch connected between a fifth node which receives the second external voltage and a sixth node connected to the first channel line, and wherein the data driver further controls operation of the third switch based on the channel control signal.

5. The display apparatus of claim 1, wherein the external voltage generator comprises:

a multiplexer which selects the first selection level based on the external voltage selection signal to output the first external voltage.

6. The display apparatus of claim 1, wherein the display panel further comprises:

a second pixel connected to the first data line and adjacent to the first pixel, and wherein the timing controller compares first input image data corresponding to the first pixel and second input image data corresponding to the second pixel to generate the channel control signal.

7. The display apparatus of claim 6, wherein the display panel further comprises:

a second data line and third and fourth pixels connected to the second data line and adjacent to each other, and wherein the timing controller further compares third input image data corresponding to the third pixel and fourth input image data corresponding to the fourth pixel to generate the channel control signal, and wherein the channel voltage generator further generates a second channel voltage corresponding to the third pixel based on the data signal, and wherein the data driver further comprises:

a second channel line connected to the second data line;

a third switch connected between a fifth node which receives the second channel voltage and a sixth node connected to the second channel line; and a fourth switch connected between a seventh node which receives the first external voltage and an eighth node connected to the second channel line, and wherein the data driver further controls operations of the third and fourth switches based on the channel control signal.

8. The display apparatus of claim 1, wherein the display panel further comprises:

a second data line adjacent to the first data line, and wherein the data driver further comprises:

a second channel line connected to the second data line; and a third switch connected between a fifth node connected to the first channel line and a sixth node connected to the second channel line, and wherein the data driver further controls operations of the third switch based on the channel control signal.

9. The display apparatus of claim 1, wherein when the first switch is turned on, the second switch is turned off, and wherein when the first switch is turned off, the second switch is turned on.

10. The display apparatus of claim 1, wherein the first pixel is turned on during a first horizontal duration including early and latter parts, and wherein the first switch is turned off during the early part and the second switch is turned off during the latter part.

11. The display apparatus of claim 10, wherein the latter part is subsequent to the early part.

12. A method of driving a display apparatus, the method comprising:

generating an external voltage selection signal based on first input image data corresponding to pixels included in a first pixel group, the first pixel group comprising the first pixel and disposed on a first horizontal line of a display panel, a channel control signal and a data signal based on input image data;

selecting one of first voltage levels based on the external voltage selection signal corresponding to the first horizontal line to generate a first external voltage having a first selection level;

generating a first channel voltage corresponding to a first pixel based on the data signal; and applying one of the first external voltage and the first channel voltage to the first pixel based on the channel control signal, wherein the generating the external voltage selection signal comprises:

classifying each of data voltages corresponding to the first input image data to one of voltage ranges, and wherein the selecting the one of the first voltage levels comprises:

selecting the first selection level corresponding to a first voltage range based on the external voltage selection signal, the first voltage range among the voltage ranges including a greatest number of the data voltages.

13. The method of claim 12, wherein the selecting the one of the first voltage levels comprises:

selecting one of second voltage levels based on the external voltage selection signal to generate a second external voltage having a second selection level.

14. The method of claim 12, wherein the generating the channel control signal comprises:

comparing first input image data corresponding to the first pixel and second input image data corresponding to a second pixel to generate the channel control signal, the second pixel being adjacent to the first pixel.

15. The method of claim 12, wherein the applying the one of the first external voltage and the first channel voltage comprises:

applying the first external voltage to the first pixel during a first horizontal duration; and applying the first channel voltage to the first pixel during a second horizontal duration.

16. The method of claim 15, wherein the second horizontal duration is subsequent to the first horizontal duration.

* * * * *